US008660443B2

(12) United States Patent
Barry

(10) Patent No.: US 8,660,443 B2
(45) **Date of Patent: *Feb. 25, 2014**

(54) SYSTEMS FOR DETECTING LOW TONER IN AN ELECTRO-PHOTOGRAPHIC TONER CARTRIDGE

(71) Applicant: Lexmark International, Inc., Lexington, KY (US)

(72) Inventor: Raymond Jay Barry, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/780,214

(22) Filed: Feb. 28, 2013

(65) Prior Publication Data

US 2013/0177327 A1 Jul. 11, 2013

Related U.S. Application Data

(63) Continuation of application No. 12/885,129, filed on Sep. 17, 2010, now Pat. No. 8,412,058.

(51) Int. Cl.
*G03G 15/08* (2006.01)

(52) U.S. Cl.
USPC ..... 399/27

(58) Field of Classification Search
USPC ..... 399/27, 29, 61, 62, 64
See application file for complete search history.

(56) References Cited

U.S. PATENT DOCUMENTS

| | | | | |
|---|---|---|---|---|
| 5,617,195 | A | 4/1997 | Torimaru et al. | |
| 7,218,871 | B2 | 5/2007 | Ogata | |
| 8,412,058 | B2 * | 4/2013 | Barry | 399/27 |
| 2003/0021609 | A1 | 1/2003 | Yamaguchi et al. | |

* cited by examiner

*Primary Examiner* — Susan Lee
(74) *Attorney, Agent, or Firm* — Justin M Tromp

(57) ABSTRACT

An electrophotographic image forming device according to one example embodiment includes an optical emitter positioned to emit a light beam through a window into a reservoir holding toner toward a reflective surface in the reservoir as a paddle positioned within the reservoir rotates. An optical receiver is positioned to sense an amount of the light beam reflected by the reflective surface. At least one processor is configured to receive a signal related to the amount of light sensed by the optical receiver. The at least one processor includes computer executable program instructions including: instructions for calculating an average value for the signal for each of a plurality of sets of paddle revolutions, instructions for calculating a variation value for the signal for each of the plurality of sets of paddle revolutions, instructions for filtering each variation value to determine a plurality of short term variation values, instructions for monitoring whether at least one short term variation value exceeds a first threshold, and instructions for signaling that a toner level in the reservoir is low when the at least one short term variation value exceeds the first threshold.

17 Claims, 7 Drawing Sheets

SYSTEMS FOR DETECTING LOW TONER IN AN ELECTRO-PHOTOGRAPHIC TONER CARTRIDGE

CROSS REFERENCES TO RELATED APPLICATIONS

This patent application is a continuation application of U.S. patent application Ser. No. 12/885,129, filed Sep. 17, 2010, entitled "Method for Determining Low Toner in an Electro-photographic Toner Cartridge."

BACKGROUND

1. Field of the Invention

The present invention relates generally to an electro-photographic toner cartridge, and more specifically to systems for detecting low toner in an electro-photographic toner cartridge using a light beam to detect the presence or absence of toner in the cartridge.

2. Description of the Related Art

Conventional electro-photographic printers comprise a toner cartridge having a chamber therein filled with toner. During the print process, toner is transferred from the chamber to print media thereby decreasing the amount of toner within the chamber over the life of the cartridge. When the toner level in the chamber approaches empty, the print quality may suffer. Ultimately, when the chamber is substantially empty, the printer will no longer be able to transfer images to print media. Accordingly, it is desirable to detect and signal to a user when the toner level within the toner cartridge chamber is low.

If toner low notification occurs too late, print quality may already be suffering. Further, late notification may not provide the user with sufficient time to replace the toner. Conversely, if the notification is too early, ample toner may remain in the cartridge and the user may replace the cartridge prematurely. Accordingly, a method for detecting low toner before print quality suffers without indicating low toner prematurely is desirable.

Given the foregoing, it will be appreciated that a method for detecting low toner in an electro-photographic toner cartridge that signals that the toner is low at an optimum time is preferable.

SUMMARY OF THE INVENTION

An electrophotographic image forming device according to one example embodiment includes an optical emitter positioned to emit a light beam through a window into a reservoir holding toner toward a reflective surface in the reservoir as a paddle positioned within the reservoir rotates. An optical receiver is positioned to sense an amount of the light beam reflected by the reflective surface. At least one processor is configured to receive a signal related to the amount of light sensed by the optical receiver. The at least one processor includes computer executable program instructions including: instructions for calculating an average value for the signal for each of a plurality of sets of paddle revolutions, instructions for calculating a variation value for the signal for each of the plurality of sets of paddle revolutions, instructions for filtering each variation value to determine a plurality of short term variation values, instructions for monitoring whether at least one short term variation value exceeds a first threshold, and instructions for signaling that a toner level in the reservoir is low when the at least one short term variation value exceeds the first threshold.

BRIEF DESCRIPTION OF THE DRAWINGS

The above-mentioned and other features and advantages of the various embodiments of the invention, and the manner of attaining them, will become more apparent and the invention will be better understood by reference to the following description of embodiments of the invention taken in conjunction with the accompanying drawings, wherein.

DETAILED DESCRIPTION

Figure 1:
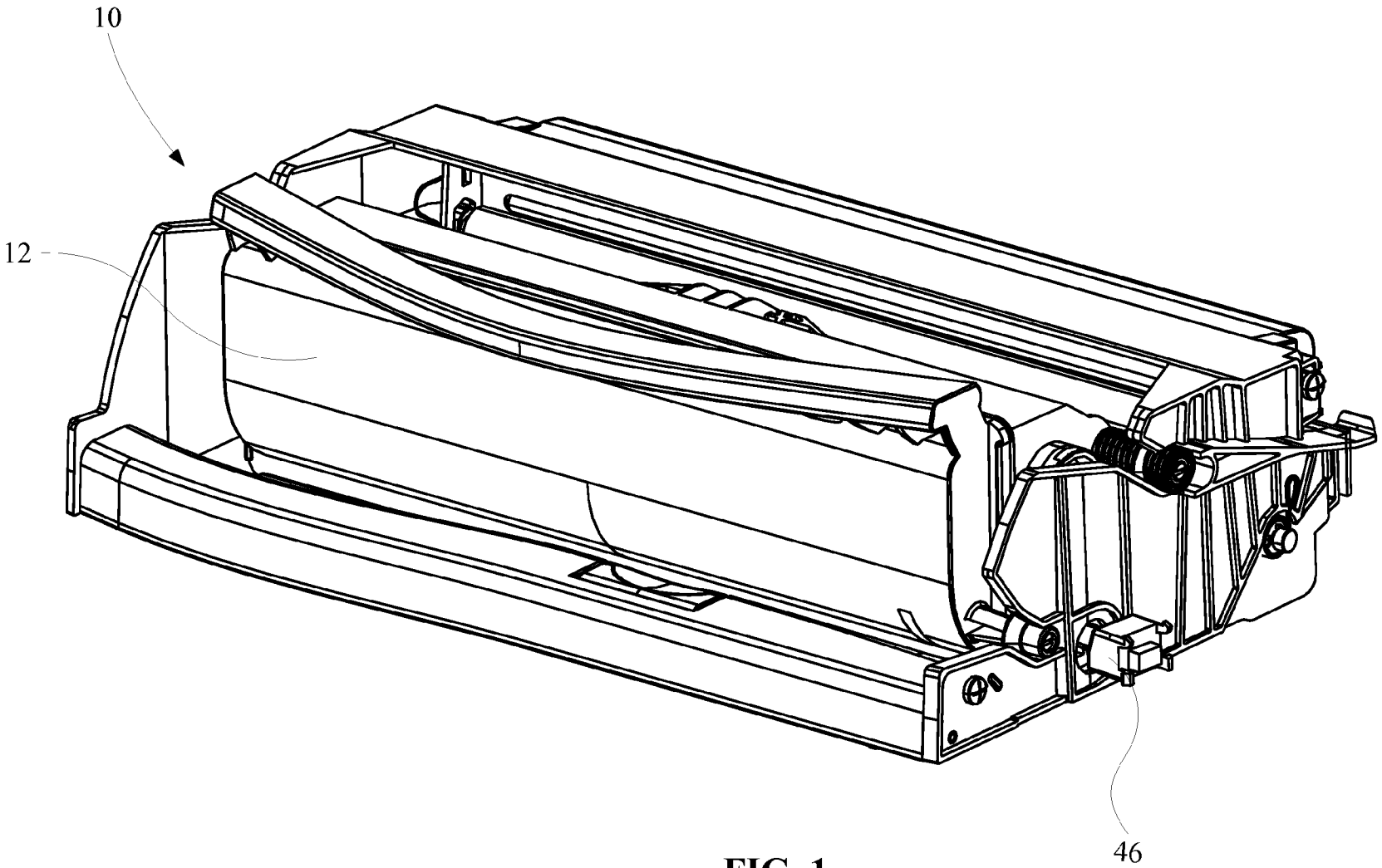
FIG. 1 is a perspective view of a toner cartridge.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware.

Figure 2:
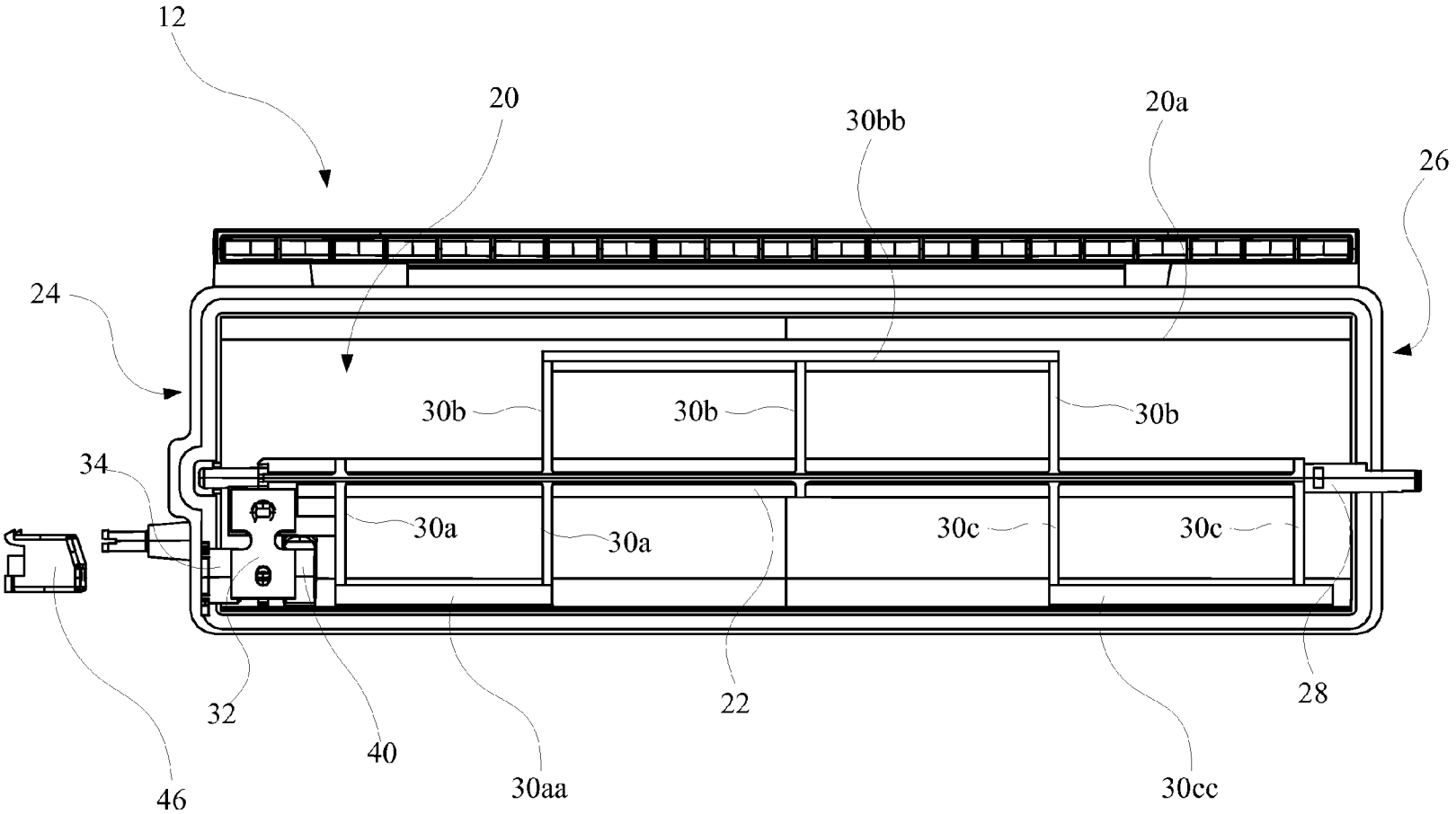
FIG. 2 is a sectioned elevation view of the interior of a developer unit showing a toner chamber.
Figure 3:
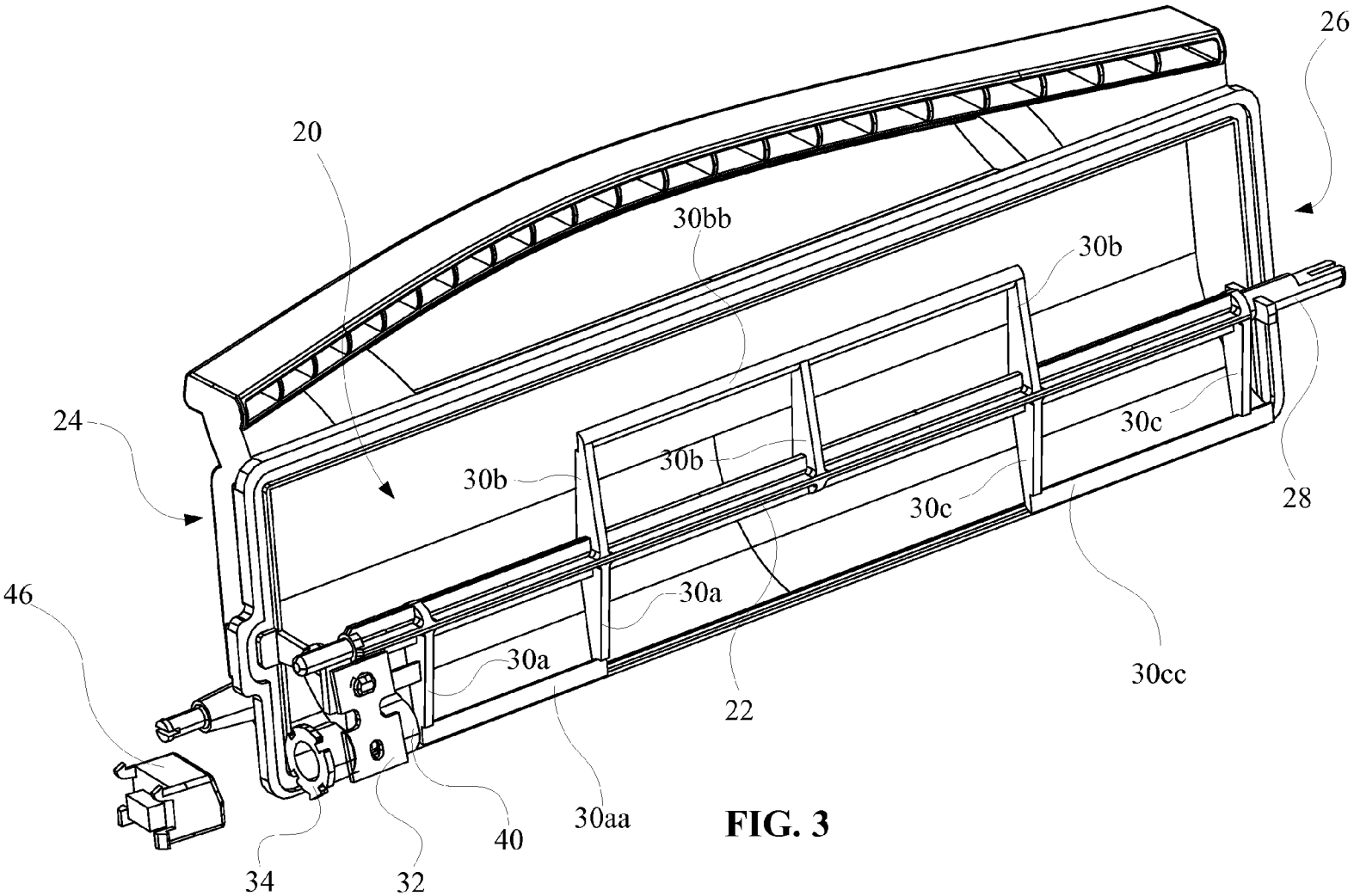
FIG. 3 is a sectioned perspective view showing a toner chamber.

With reference to FIG. 1, an electro-photographic toner cartridge 10 is shown having a developer unit 12 therewith. With reference to FIGS. 2 and 3, a toner chamber 20 is disposed within the developer unit 12. In operation, the toner chamber 20 contains toner. The toner chamber 20 includes a long dimension in which a toner paddle 22 is mounted. The paddle 22 extends across the long dimension generally perpendicular to a first end 24 and a second end 26 of the chamber 20. In multiple embodiments, the long dimension of the cartridge 10 is at least the width of the paper or other media being imaged. In some embodiments, this is more than the 8½ inches width of paper widely used in the United States.

The paddle 22 has a central, driven shaft 28 extending across the long dimension of the chamber 20. In operation, the shaft 28 is rotated by a driving member from an imaging device (not shown). In some embodiments, the paddle 22 has stirring extensions 30*a*, 30*b*, and 30*c*, which extend to near the inner walls 20*a* of chamber 20 and which have cross members 30*aa*, 30*bb*, and 30*cc* extending parallel to the shaft 28. Embodiments include those wherein cross member 30*bb* is wider than cross members 30*aa* or 30*cc* so as to distribute the stirring action of paddle 22.

At the first end 24, on the shaft 28, is a flexible wiper blade 32. In some embodiments, the wiper blade 32 is made of a solid urethane polymer. However, the wiper blade 32 may be made of any suitable material. Embodiments include those wherein the wiper blade 32 is mounted to the shaft 28 by a bolt fixed on an extension from the shaft 28. However, the wiper blade 32 may be fixed to the shaft 28 by various alternatives such as, for example, being wrapped around the shaft 28 and held by adhesive or by a rivet.

Figure 4:
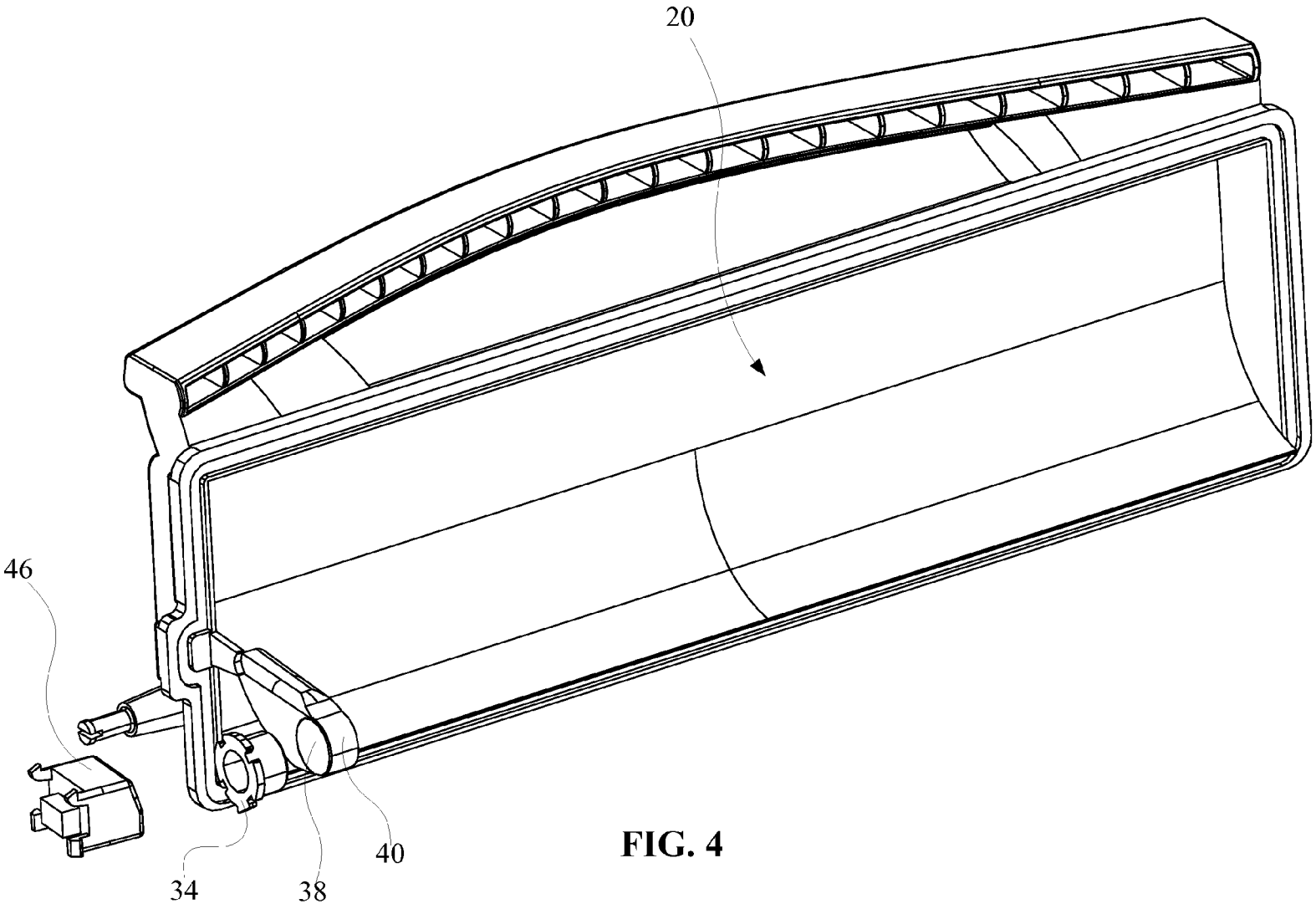
FIG. 4 is a sectioned perspective view showing a toner chamber with the paddle and associated cross members removed.
Figure 5:
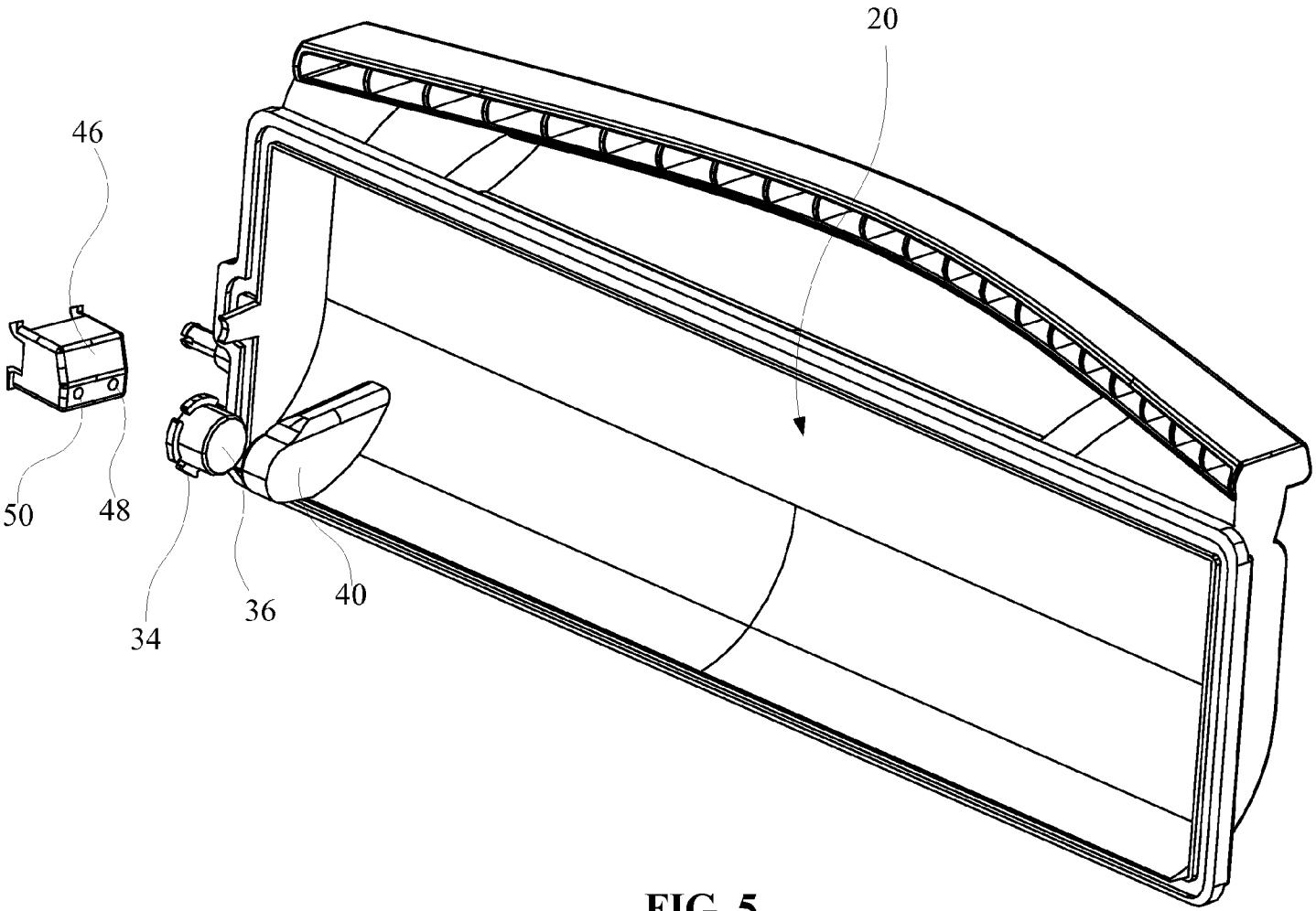
FIG. 5 is a sectioned perspective view showing a toner chamber with the paddle and associated cross members removed.

With reference to FIGS. 4 and 5, a transparent plate or window 36 is disposed at the first end 24 of the chamber 20 on a first extension 34 from the chamber 20. The window 36 may be any material which is transparent to light and is sturdy enough to hold toner inside of the chamber 20. Embodiments include those wherein the window 36 is made of polycarbonate.

Opposite the window 36 is a reflective surface 38. In some embodiments, the reflective surface 38 is spaced less than about 40 millimeters from the window 36. In one exemplary embodiment, the reflective surface 38 is about 10 millimeters away from the window 36. The wiper blade 32 passes through the space between the window 36 and the reflective surface 38 once per paddle 22 revolution. As the wiper blade 32 passes through the space between the window 36 and the reflective surface 38, opposite sides of the wiper blade 32 contact the window 36 and the reflective surface 38, thereby cleaning the two surfaces to allow light to pass through the window 36 and be reflected by the reflective surface 38 back through the window 36.

Embodiments include those wherein the reflective surface 38 is an aluminized plastic sheet which is physically supported in the chamber 20 by a second extension 40 from the chamber 20. As the paddle 22 rotates, it distributes toner so that toner remaining after use tends to settle evenly across the bottom of the chamber 20, including the area of the bottom of the chamber 20 between the window 36 and the reflective surface 38.

Figure 6:
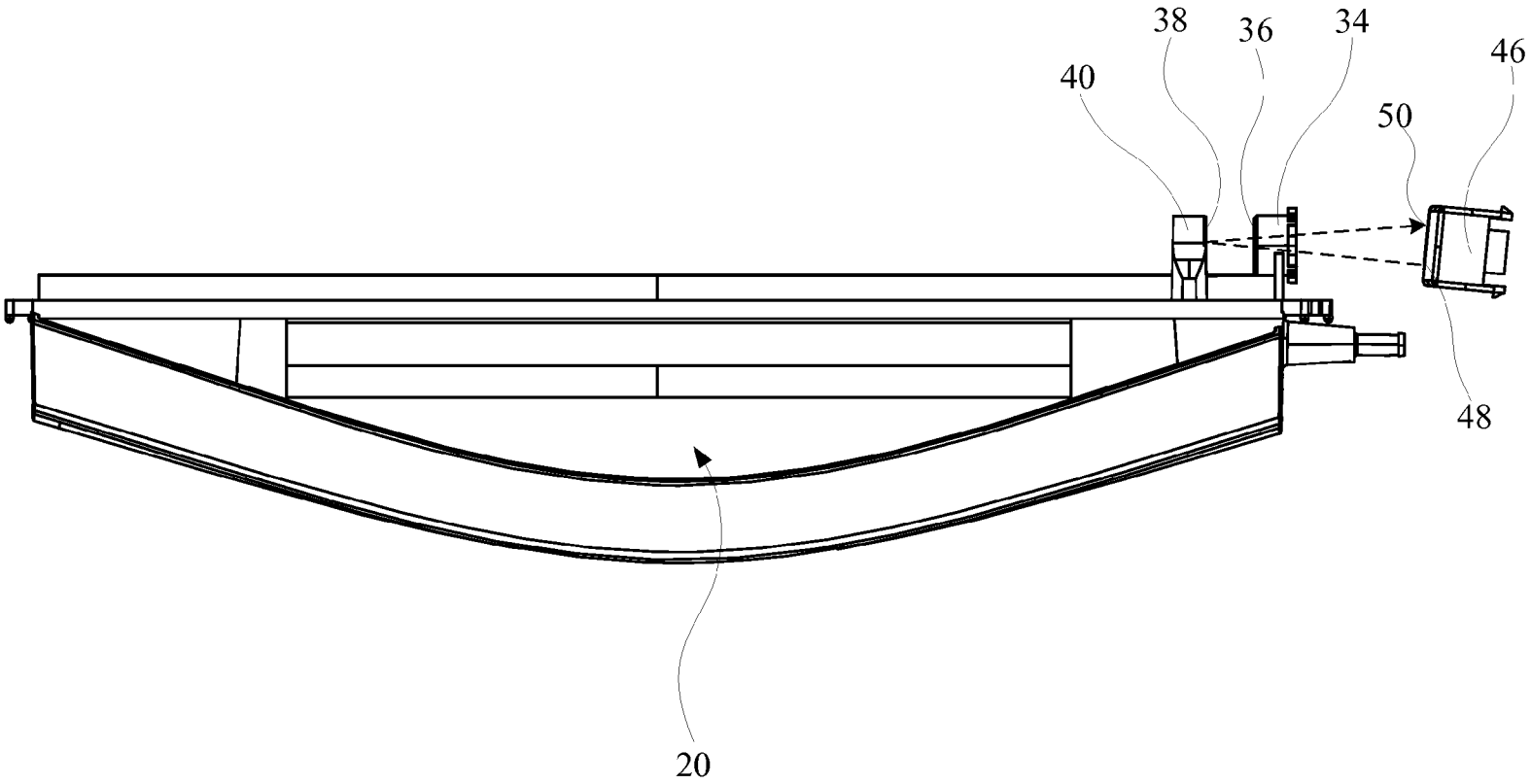
FIG. 6 is a sectioned plan view of a toner chamber showing the optical path of an optical sensor.

With reference to FIGS. 5 and 6, an optical sensor 46 is spaced outside of the chamber 20 as part of the imaging device. The optical sensor 46 is positioned immediately outside the window 36. The optical sensor 46 has an emitter 48 and a receiver 50. In some embodiments, the emitter 48 and the receiver 50 are mounted together for structural convenience. Alternatives include those wherein a separate emitter 48 and separate receiver 50 are utilized. In some embodiments, the emitter 48 emits infrared light and the receiver 50 receives infrared light. Embodiments include those wherein the emitter 48 is an LED emitter.

In operation, when printing occurs, toner is carried from the chamber 20 in small amounts by a developer roller (not shown) and a doctor blade (not shown). The paddle 22 rotates whenever printing takes place in order to keep the toner in the chamber 20 fluffed up and to push the toner towards the developer roller for removal from the chamber 20 for use in the printing process. As the paddle 22 rotates, at periodic intervals, the electronic controls of the imaging device having optical sensor 46, cause light to be emitted from the emitter 48 and observe any sensing of that light on the receiver 50. The emitter 48 emits light through the window 36 toward the reflective surface 38 continuously during each paddle 22 revolution. The receiver 50 senses the amount of light reflected through the window 36 by the reflective surface 38. When no toner is present between the window 36 and the reflective surface 38, the amount of light reflected is high. Conversely, when toner is present between the window 36 and the reflective surface 38, the amount of light reflected is low because the toner blocks the optical path. For most of the life of the cartridge 10, as soon as the wiper blade 32 exits the space between the window 36 and the reflective surface 38, toner falls back into the space, blocking the optical path. There is often a brief period of time after the wiper blade 32 passes through the space between the window 36 and the reflective surface 38 where the optical path is unblocked. As the toner level within the chamber 20 approaches empty, the time period during each revolution of the paddle 22 in which the optical path is unblocked increases. Testing has shown that on a short time scale, the behavior of the toner and its blockage of the optical path is relatively random.

Figure 7:
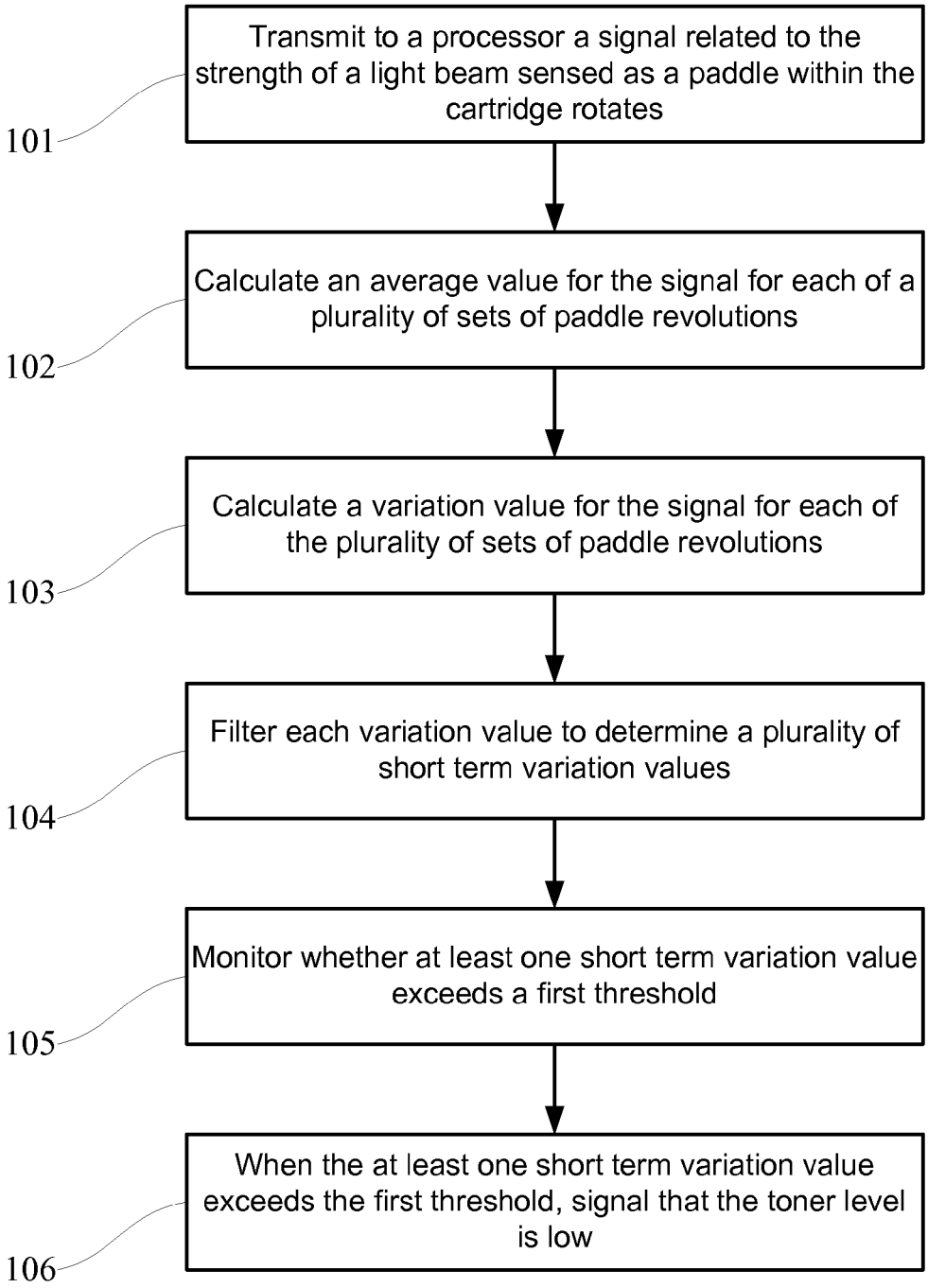
FIG. 7 is a flow chart of a method for detecting low toner in an electro-photographic toner cartridge.

With reference to FIG. 7, a method for detecting low toner in an electro-photographic toner cartridge having an optical sensor using a light beam to detect the presence or absence of toner in the cartridge is provided. At step 101, the optical sensor 46 transmits a signal related to the strength of the light beam sensed by the receiver 50 to a processor (not shown). In some embodiments, the optical sensor 46 transmits an analog output voltage related to the strength of each light beam sensed by the receiver 50 to an analog to digital (A/D) converter. A digital output voltage sample is then transmitted from the A/D converter to the processor. In one exemplary embodiment, a sample is taken every 16 milliseconds. This means multiple readings can occur for each paddle 22 revolution depending on the rotational speed of the paddle 22. Embodiments include those wherein the signal transmitted to the processor is inversely related to the strength of the light beam sensed by the receiver 50. In these embodiments, as the amount of light received increases, the signal strength decreases. Alternatives include those wherein the signal is directly related to the strength of the light beam sensed by the receiver 50 such that as the amount of light increases, the signal strength increases.

In multiple embodiments, the processor counts the number of revolutions N of the paddle 22 over the life of the cartridge 10. Each revolution of the paddle 22 has an associated value N such that for the first paddle 22 revolution, N=1, for the second revolution, N=2, and so on.

At step 102, the processor calculates an average value for the signal for each of a plurality of sets of paddle 22 revolutions. Embodiments include those wherein each set of paddle 22 revolutions consists of one paddle 22 revolution such that the processor calculates an average value for the signal for each revolution of the paddle 22. Alternatives include those wherein each set of paddle 22 revolutions consists of multiple revolutions of the paddle 22. The average value for the signal is the average strength of the signals transmitted to the processor during a set of paddle 22 revolutions. In some embodiments, the average value for the signal is an average paddle cycle voltage value $V_{PCA,N}$, where N corresponds with a specific paddle 22 revolution such that the first paddle 22 revolution has an average paddle cycle voltage value $V_{PCA,1}$, the second paddle 22 revolution has an average paddle cycle voltage value $V_{PCA,2}$ and so on. The average paddle cycle voltage value $V_{PCA,N}$ is determined by calculating the average voltage transmitted to the processor during a paddle 22 revolution. For example, if during the fiftieth paddle 22 revolution five signals are transmitted to the processor, the signals measuring 2.5 V, 2.5 V, 2.5 V, 2.5 V and 0 V respectively, then $V_{PCA,50}$=2.0 V. In the embodiments where the signal is inversely related to the amount of light sensed, $V_{PCA,N}$ decreases as the amount of toner in the chamber 20 decreases.

Prior to the first use of the cartridge 10, toner within the cartridge 10 may be concentrated at one end of the chamber 20. Accordingly, in order to allow the toner to settle into a normal distribution, in some embodiments, prior to calculating an average value for the signal transmitted to the processor, the processor first counts a predetermined number of paddle 22 revolutions. This allows the processor to ignore data from the initial period of the cartridge 10 when the toner within the chamber 20 may be concentrated at one end. In some embodiments, the first 100 revolutions of the paddle 22 are counted before the processor begins to calculate an average value for the signal transmitted to the processor.

Generally, the sensitivity of each optical sensor 46 differs. Therefore, it is difficult to determine in advance a specific average signal value for a given optical sensor that will indicate that the toner is low. Accordingly, in some embodiments, each average value for the signal is normalized. Embodiments include those wherein the processor determines the maximum signal value and the minimum signal value transmitted to the processor. The maximum and minimum signal values are tracked over the life of the cartridge 10 and are stored in non-volatile memory. During each paddle 22 revolution, the processor compares each signal with the recorded maximum and minimum signal values to date. If a signal exceeds the maximum signal value, the processor updates the maximum with the new value. Similarly, if a signal falls below the minimum signal value, the processor updates the minimum with the new value. In some embodiments, the maximum and minimum signal values are used to determine a normalized average paddle cycle voltage value $V_{NPCA,N}$ according to the following formula: $V_{NPCA,N}=(V_{PCA,N}-V_{min})/(V_{max}-V_{mm})$. This formula produces a $V_{NPCA,N}$ between zero and one. If approximately 100% of the light transmitted from the emitter 46 is received by the receiver 50 and the signal transmitted to the processor is inversely related to the amount of light sensed, then $V_{NPCA,N}$ will be close to zero. Conversely, in this example, if the optical path is blocked approximately 100% of the time, then $V_{NPCA,N}$ will be close to one.

Testing has shown that the average value for the signal for each of the plurality of sets of paddle 22 revolutions has a substantial amount of short term randomness. Accordingly, in some embodiments, each average value for the signal is filtered to negate a portion of the short term variation in order to assist with detecting the long term trends of the signal. Embodiments include those wherein the average value for the signal is first normalized and then filtered and those wherein the average value for the signal is first filtered and then normalized. Further, embodiments include those wherein the average value for the signal is filtered but not normalized and those wherein the average value for the signal is normalized but not filtered. In some embodiments, a filtered average paddle cycle voltage value $V_{FPCA,N}$ is determined by low-pass filtering each $V_{NPCA,N}$ value. This low-pass filtering can be accomplished using the formula: $V_{FPCA,N+1}=V_{FPCA,N}+((V_{NPCA,N+1}-V_{FPCA,N})/X)$. In some embodiments, X is a constant. The constant X may be any suitable number, for example 100. Alternatives include those wherein X depends on the number of paddle 22 revolutions N. The larger the value X, the slower the filtered value reacts to changes. Accordingly, a larger value X results in a longer delay in detecting long term signal shifts.

A decrease in the average value for the signal generally indicates that the toner in the cartridge 10 is low. Testing has shown that the randomness of the average value for the signal increases just before the average value for the signal begins to fall. Accordingly, the variation of the average value for the signal can be analyzed to determine when the toner in the cartridge 10 is low. At step 103, the processor calculates a variation value for the signal for each of the plurality of sets of paddle 22 revolutions. In some embodiments, a variation value $Var_N$ for the signal is calculated for each paddle 22 revolution where N corresponds with a specific paddle 22 revolution such that the first paddle 22 revolution has a variation value $Var_1$, the second paddle 22 revolution has a variation value $Var_2$ and so on. Embodiments include those wherein the variation value is determined by calculating the variance of the average value for signal or by calculating the standard deviation of the average value for signal. In some embodiments, the variation value is based on the difference between $V_{FPCA,N}$ and $V_{NPCA,N}$. For example, $Var_N=|V_{FPCA,N}-V_{NPCA,N}|$. Alternatives include: $Var_N=(V_{FPCA,N}-V_{NPCA,N})^2$, $Var_N$=the square root of $(V_{FPCA,N}-V_{NPCA,N})^2$, and $Var_N=V_{FPCA,N}-V_{NPCA,N}$.

Embodiments include those wherein the processor calculates a long term average variation value for each of the plurality of sets of paddle 22 revolutions. In some embodiments a long term average variation value $Var_{LA,N}$ is calculated for each paddle 22 revolution where N corresponds with a specific paddle 22 revolution such that the first paddle 22 revolution has a long term average variation value $Var_{LA,1}$, the second paddle 22 revolution has a long term average variation value $Var_{LA,2}$ and so on. Embodiments include those wherein each $Var_{LA,N}$ value is the lifetime average of the $Var_N$ values to date. Alternatives include those wherein $Var_{LA,N+1}=((Var_{LA,N}*N)+Var_{N+1})/(N+1)$. Additional alternatives include those wherein each $Var_{LA,N}$ is determined by filtering each $Var_N$ value. Embodiments include those wherein $Var_{LA,N}$ is determined by low-pass filtering each $Var_N$ value. This low-pass filtering can be accomplished using the formula:

$$Var_{LA,N+1}=Var_{LA,N}+((Var_{N+1}-Var_{LA,N})/Y).$$

In some embodiments, Y is a constant. Alternatives include those wherein Y depends on the number of paddle 22 revolutions N. The larger the value Y, the slower the long term average variation value reacts to changes in the variation value.

At step 104, the processor filters each variation value to determine a plurality of short term variation values. In some embodiments, a short term variation value $Var_{S,N}$ is calculated for each paddle 22 revolution where N corresponds with a specific paddle 22 revolution such that the first paddle 22 revolution has a short term variation value $Var_{S,1}$, the second paddle 22 revolution has a short term variation value $Var_{S,2}$ and so on. Embodiments include those wherein $Var_{S,N}$ is determined by low-pass filtering each $Var_N$ value. This low-pass filtering can be accomplished using the formula:

$$Var_{S,N+1}=Var_{S,N}+((Var_{N+1}-Var_{S,N})/Z).$$

In some embodiments, Z is a constant. The constant Z may be any suitable number, for example 50. Alternatives include those wherein Z depends on the number of paddle 22 revolutions N. In embodiments where $Var_{LA,N}$ is determined by low-pass filtering, Y should be greater than Z so that $Var_{LA,N}$ reacts to changes in $Var_N$ slower than $Var_{S,N}$. In some embodiments, over a predetermined number of paddle 22 revolutions at the beginning of the life of the cartridge 10, the short term variation is initialized by replacing the short term variation value calculated with the corresponding long term average variation value. For example, for $N\leq 50$, $Var_{S,N}=Var_{LA,N}$.

At step 105, the processor monitors whether at least one short term variation value exceeds a first threshold. The term "exceeds" as used herein is meant to encompass either monitoring whether a variable is greater than or equal to (≥) a threshold or monitoring whether a variable is greater than (>) a threshold. The first threshold should be large enough to ensure that the increased signal variation is due to low toner but small enough to provide a timely notification that the toner is low. Embodiments include those wherein the first threshold is a function of the long term average variation value. In some embodiments, the first threshold is equal to $Var_{LA,N}$ multiplied by a constant, such as, for example, two. In this exemplary embodiment, the processor monitors whether $Var_{S,N}>Var_{LA,N}*2$. In some embodiments, the first threshold has a minimum value to make certain that the first threshold is large enough to ensure that the increased signal variation is due to low toner. For example, where the first threshold is a function of $Var_{LA,N}$, the minimum first threshold may be 0.02.

In some embodiments, testing has shown that if the cartridge 10 is removed from the imaging device and the toner is redistributed within the chamber 20 toward the second end 26 of the chamber 20, in some cases, it may take a few paddle 22 revolutions for the toner to redistribute normally across the chamber 20. During this redistribution, it is possible that $Var_{S,N}$ will exceed the first threshold, falsely indicating that the toner is low. In some embodiments, in order to ensure that the satisfaction of the first threshold is due to low toner and not a redistribution of toner within the chamber 20, the processor monitors whether at least one $Var_N$ value exceeds a second threshold. Embodiments include those wherein the second threshold is a function of $Var_{LA,N}$. In some embodiments, the second threshold is equal to $Var_{LA,N}$ multiplied by a constant, such as, for example, 10. In this exemplary embodiment, the processor monitors whether $Var_N>Var_{LA,N}*10$. Testing has shown that under normal operation, $Var_N$ will be less than $Var_{LA,N}*10$; accordingly, satisfaction of the second threshold indicates that the toner has been redistributed. Embodiments include those wherein when $Var_N$ exceeds the second threshold, the $Var_N$ value is deemed unreliable and replaced with $Var_{LA,N}$. For example, if the one-hundredth variation value $Var_{S,N}$ exceeds the second threshold, $Var_{100}$ is replaced with $Var_{LA,100}$. Alternatives include those wherein when $Var_N$ exceeds the second threshold, the processor stops monitoring whether $Var_{S,N}$ exceeds the first threshold for a predetermined number of paddle 22 revolutions; after the predetermined number of paddle 22 revolutions, the processor resumes monitoring whether $Var_{S,N}$ exceeds the first threshold. This alternative essentially ignores the data recorded after a large redistribution of toner in order to prevent a false determination that the toner level is low.

At step 106, when the at least one short term variation value exceeds the first threshold, the processor signals that the toner level is low. The signaling may include any conventional means for signaling or alerting a user such as, for example, activating an indicator (not shown), such as, for example, an LED, disposed on the imaging device or activating a display on a display device (not shown), such as, for example, an LCD screen, disposed on the imaging device.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An electrophotographic image forming device, comprising:

an optical emitter positioned to emit a light beam through a window into a reservoir of a toner cartridge holding toner toward a reflective surface in the reservoir as a paddle positioned within the reservoir rotates; and an optical receiver positioned to sense an amount of the light beam reflected by the reflective surface; and at least one processor configured to receive a signal related to the amount of light sensed by the optical receiver, the at least one processor including computer executable program instructions, including:

instructions for calculating an average value for the signal for each of a plurality of sets of paddle revolutions;

instructions for calculating a variation value for the signal for each of the plurality of sets of paddle revolutions;

instructions for filtering each variation value to determine a plurality of short term variation values;

instructions for monitoring whether at least one short term variation value exceeds a first threshold; and instructions for signaling that a toner level in the reservoir is low when the at least one short term variation value exceeds the first threshold.

2. The electrophotographic image forming device of claim 1, further comprising instructions for normalizing each average value for the signal to determine a plurality of normalized average values for the signal.

3. The electrophotographic image forming device of claim 1, further comprising instructions for filtering each average value for the signal to determine a plurality of filtered average values for the signal.

4. The electrophotographic image forming device of claim 1, further comprising instructions for calculating a long term average variation value for each of the plurality of sets of paddle revolutions, the first threshold being a function of the long term average variation.

5. The electrophotographic image forming device of claim 4, wherein each long term average variation value is determined by a method selected from the group consisting of averaging the variation values for the signal to date and filtering each variation value for the signal.

6. The electrophotographic image forming device of claim 4, further comprising instructions for monitoring whether at least one variation value for the signal exceeds a second threshold and, when the at least one variation value for the signal exceeds the second threshold, performing a step selected from the group consisting of:

replacing the at least one variation value for the signal with a corresponding long term average variation value; and for a predetermined number of paddle revolutions, stop monitoring whether the at least one short term variation value exceeds the first threshold, after the predetermined number of paddle revolutions, resume monitoring whether the at least one short term variation value exceeds the first threshold.

7. The electrophotographic image forming device of claim 4, further comprising instructions for counting the number of revolutions of the paddle and for a predetermined number of paddle revolutions at the beginning of the life of the toner cartridge, setting each short term variation value equal to a corresponding long term average variation value.

8. The electrophotographic image forming device of claim 1, further comprising instructions for counting a predetermined number of paddle revolutions before calculating the average value for the signal for the plurality of sets of paddle revolutions.

9. The electrophotographic image forming device of claim 1, further comprising at least one of an indicator on the image forming device and a display device on the image forming device, wherein signaling that the toner level is low comprises a step selected from the group consisting of: activating the indicator and activating a display on the display device.

10. A non-transitory computer readable storage medium having computer executable program instructions which, when executed by a processor, cause the processor to:

calculate an average value for a signal received by the processor related to the strength of a light beam sensed for each of a plurality of sets of revolutions of a paddle positioned within a toner reservoir;

calculate a variation value for the signal for each of the plurality of sets of paddle revolutions;

filter each variation value to determine a plurality of short term variation values;

monitor whether at least one short term variation value exceeds a first threshold; and when the at least one short term variation value exceeds the first threshold, signal that a toner level in a toner cartridge is low.

11. The non-transitory computer readable storage medium of claim 10, wherein the computer executable storage instructions, when executed by the processor, cause the processor to normalize each average value for the signal to determine a plurality of normalized average values for the signal.

12. The non-transitory computer readable storage medium of claim 10, wherein the computer executable storage instructions, when executed by the processor, cause the processor to filter each average value for the signal to determine a plurality of filtered average values for the signal.

13. The non-transitory computer readable storage medium of claim 10, wherein the computer executable storage instructions, when executed by the processor, cause the processor to calculate a long term average variation value for each of the plurality of sets of paddle revolutions, the first threshold being a function of the long term average variation.

14. The non-transitory computer readable storage medium of claim 13, wherein each long term average variation value is determined by a method selected from the group consisting of averaging the variation values for the signal to date and filtering each variation value for the signal.

15. The non-transitory computer readable storage medium of claim 13, wherein the computer executable storage instructions, when executed by the processor, cause the processor to monitor whether at least one variation value for the signal exceeds a second threshold and when the at least one variation value for the signal exceeds the second threshold, perform a step selected from the group consisting of:

replacing the at least one variation value for the signal with a corresponding long term average variation value; and for a predetermined number of paddle revolutions, stop monitoring whether the at least one short term variation value exceeds the first threshold, after the predetermined number of paddle revolutions, resume monitoring whether the at least one short term variation value exceeds the first threshold.

16. The non-transitory computer readable storage medium of claim 13, wherein the computer executable storage instructions, when executed by the processor, cause the processor to count the number of revolutions of the paddle and for a predetermined number of paddle revolutions at the beginning of the life of the toner cartridge, set each short term variation value equal to a corresponding long term average variation value.

17. The non-transitory computer readable storage medium of claim 10, wherein the computer executable storage instructions, when executed by the processor, cause the processor to count a predetermined number of paddle revolutions before calculating the average value for the signal for the plurality of sets of paddle revolutions.

* * * * *